US006312196B1

(12) United States Patent
Mansfield

(10) Patent No.: US 6,312,196 B1
(45) Date of Patent: Nov. 6, 2001

(54) SEA WALL AND METHOD OF CONSTRUCTION THEREOF

(76) Inventor: Peter W. Mansfield, P.O. Box 338, Urbanna, VA (US) 23175-0338

( * ) Notice: Subject to any disclaimer, the term of this patent is extended or adjusted under 35 U.S.C. 154(b) by 0 days.

(21) Appl. No.: 09/453,380

(22) Filed: Dec. 2, 1999

(51) Int. Cl.[7] ..... E02D 5/00; E02D 29/02

(52) U.S. Cl. ..... 405/286; 405/285; 405/284

(58) Field of Search ..... 405/15, 16, 17, 405/80, 107, 109, 110–114, 116, 231–233, 239, 244, 249, 256–257, 284–287, 31, 32, 262

(56) References Cited

U.S. PATENT DOCUMENTS

| | | | | |
|---|---|---|---|---|
| 738,346 | * | 9/1903 | Mouchel | 405/284 |
| 905,771 | * | 12/1908 | Upson | 405/286 |
| 1,693,311 | * | 11/1928 | Miller et al. | 405/285 |
| 2,439,606 | * | 4/1948 | Hurt | 405/285 |
| 3,739,588 | * | 6/1973 | Schroter et al. | 405/262 |
| 4,023,374 | * | 5/1977 | Colbert et al. | 405/216 |
| 4,222,684 | * | 9/1980 | Rosenstock | 405/232 |
| 4,268,192 | * | 5/1981 | Colle | 405/239 |
| 4,425,052 | * | 1/1984 | McCullers | 405/32 |
| 4,439,071 | * | 3/1984 | Roper, Jr. | 405/216 |
| 4,605,339 | * | 8/1986 | Bullivant | 405/237 |
| 5,378,082 | | 1/1995 | Hiller et al. | 405/3 |
| 5,593,247 | | 1/1997 | Endres et al. | 405/3 |
| 5,628,583 | | 5/1997 | Gibson | 405/3 |
| 5,651,641 | * | 7/1997 | Stephens et al. | 405/258 |
| 5,772,360 | | 6/1998 | Wood, II | 405/3 |
| 5,839,851 | | 11/1998 | Norfolk et al. | 405/3 |
| 5,934,826 | | 8/1999 | Mansfield | 405/3 |
| 6,135,375 | * | 10/2000 | Moreau | 405/284 |

OTHER PUBLICATIONS

Internet article "Fabriscape", 1998.*

* cited by examiner

*Primary Examiner*—Thomas B. Will
*Assistant Examiner*—Sunil Singh
(74) *Attorney, Agent, or Firm*—Charles J. Prescott

(57) ABSTRACT

A sea wall anchored into ground in proximity to a body of water comprising a plurality of elongated tubular members arranged in upright side by side relation one to another forming a sea wall section, a lower portion of each tubular member embedded into, and receiving support from, the ground along an edge of the body of water and method of installation thereof. An elongated generally horizontal rebar-reinforced concrete cap extends along, and rigidly interconnects together, each upper end portion of each of the tubular members. The cap is cast formed in place after the tubular members are installed. Each tubular member is preferably rebar-reinforced and substantially filled with a cured aggregate reinforcement. A layer of filter cloth is held in place by fill dirt placed against the land or dry side of the sea wall to substantially prevent fill dirt placed against the dry side of tubular members from washing into the body of water between adjacent tubular members. A tie back is connected at each end thereof to, and extending between, the cap and a ground anchor spaced from the tubular members.

7 Claims, 5 Drawing Sheets

SEA WALL AND METHOD OF CONSTRUCTION THEREOF

BACKGROUND OF THE INVENTION

1. Scope of Invention

This invention relates generally to sea wall construction, and more particularly to a sea wall utilizing tubular pilings or members preferably made of p.v.c. plastic and the like.

2. Prior Art

Sea walls are typically constructed utilizing formed or rolled steel or other metallic material which interlock together end to end as each elongated panel of the sea wall is installed and embedded or driven into the ground adjacent a body of water. Each of the interlocking sea wall panels is typically formed of steel and includes some corrosive resistant feature, particularly when deployed adjacent a body of salt water. However, such sea walls are known to be relatively short lived and must be replaced periodically due to rust and electrolysis at considerable expense. Interlocking PVC material is also used, but must be reinforced with pilings and longitudinal members known as whalers.

My previous U.S. Pat. No. 5,934,826 addresses, in part, one of the difficulties of using anything other than the conventional interlocking steel panels to form a sea wall. In this patent, I teach the use and deployment of tubular pilings formed of p.v.c. plastic material. Prior to the teaching in this patent, the use of such plastic tubular material was not well known. Two important aspects facilitating this invention were there disclosed, namely, a method and apparatus for embedding a plastic tubular piling into the water bed and a driving apparatus and method for deploying tubular plastic pilings into the water bottom.

The present invention adds to this teaching and expands it into the area of sea wall construction. By incorporating a tubular member formed of p.v.c. with sufficient strength, the expected service life of such sea walls is greatly extended because of the inert nature of p.v.c. material.

BRIEF SUMMARY OF THE INVENTION

This invention is directed to a sea wall anchored into ground adjacent to a body of water comprising a plurality of elongated tubular members arranged in upright side by side relation one to another forming a sea wall section, a lower portion of each tubular member embedded into, and receiving support from, the ground along an edge of the body of water and method of installation thereof. An elongated generally horizontal rebar-reinforced concrete cap extends along, and rigidly interconnects together, each upper end portion of each of the tubular members. The cap is cast formed in place after the tubular members are installed. Each tubular member is preferably rebar-reinforced and substantially filled with a cured aggregate reinforcement. A layer of filter cloth is held in place by fill did placed against the land or dry side of the sea wall to substantially prevent fill dirt placed against the dry side of tubular members from washing into the body of water between adjacent tubular members. A tie back is connected at each end thereof to, and extending between, the cap and a ground anchor spaced from the tubular members.

It is therefore an object of this invention to provide a sea wall constructed of closely spaced upright tubular members formed of p.v.c. plastic material.

It is another object of this invention to provide a sea wall with a substantially extended life span over those sea walls formed of conventional steel interlocking panels.

It is still another object of this invention to provide a method of constructing a sea wall from tubular members formed of p.v.c. plastic material.

In accordance with these and other objects which will become apparent hereinafter, the instant invention will now be described with reference to the accompanying drawings.

DETAILED DESCRIPTION OF THE INVENTION

Figure 1:
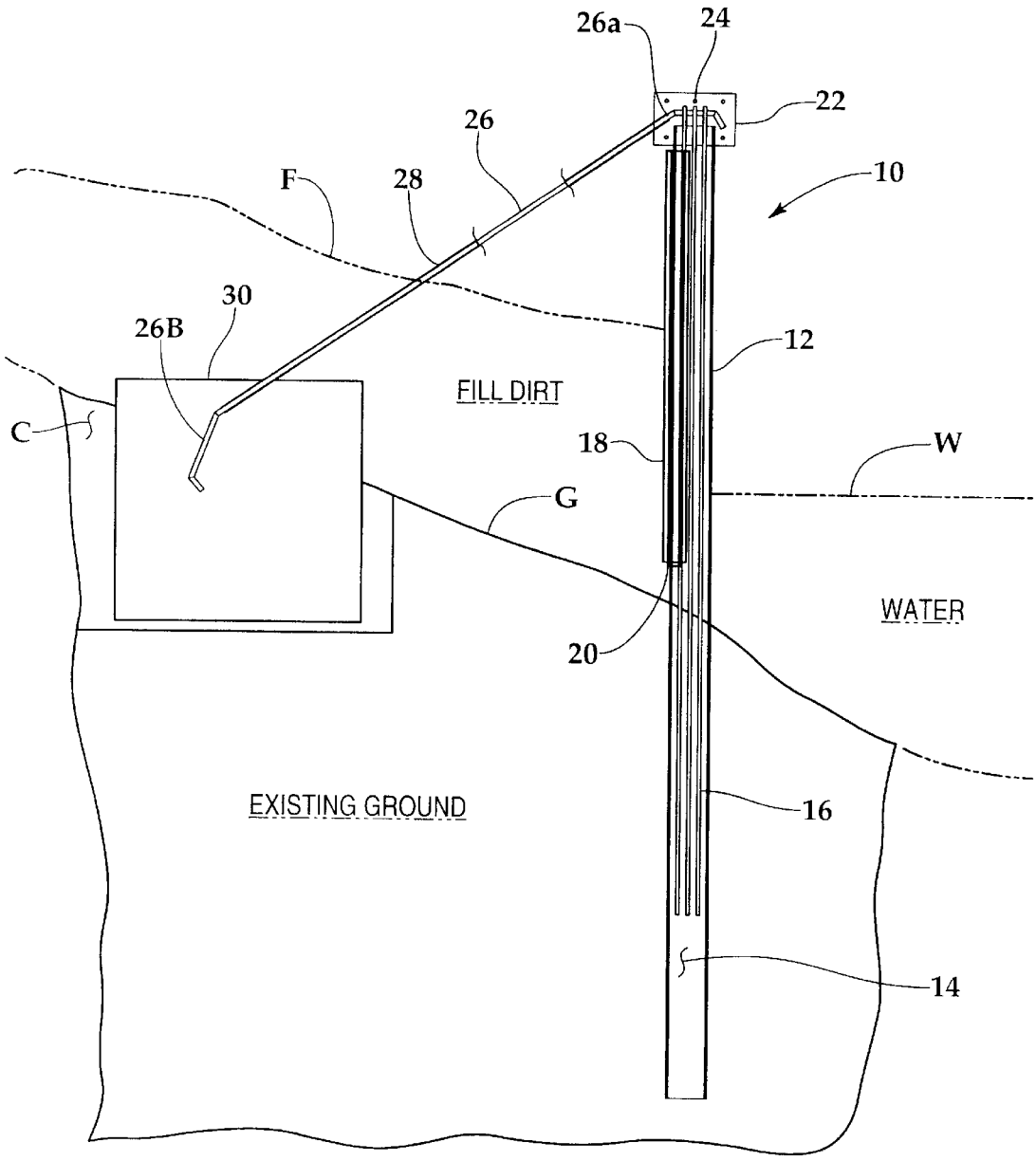
FIG. 1 is a side elevation schematic view of the invention deployed adjacent to a body of water.
Figure 3:
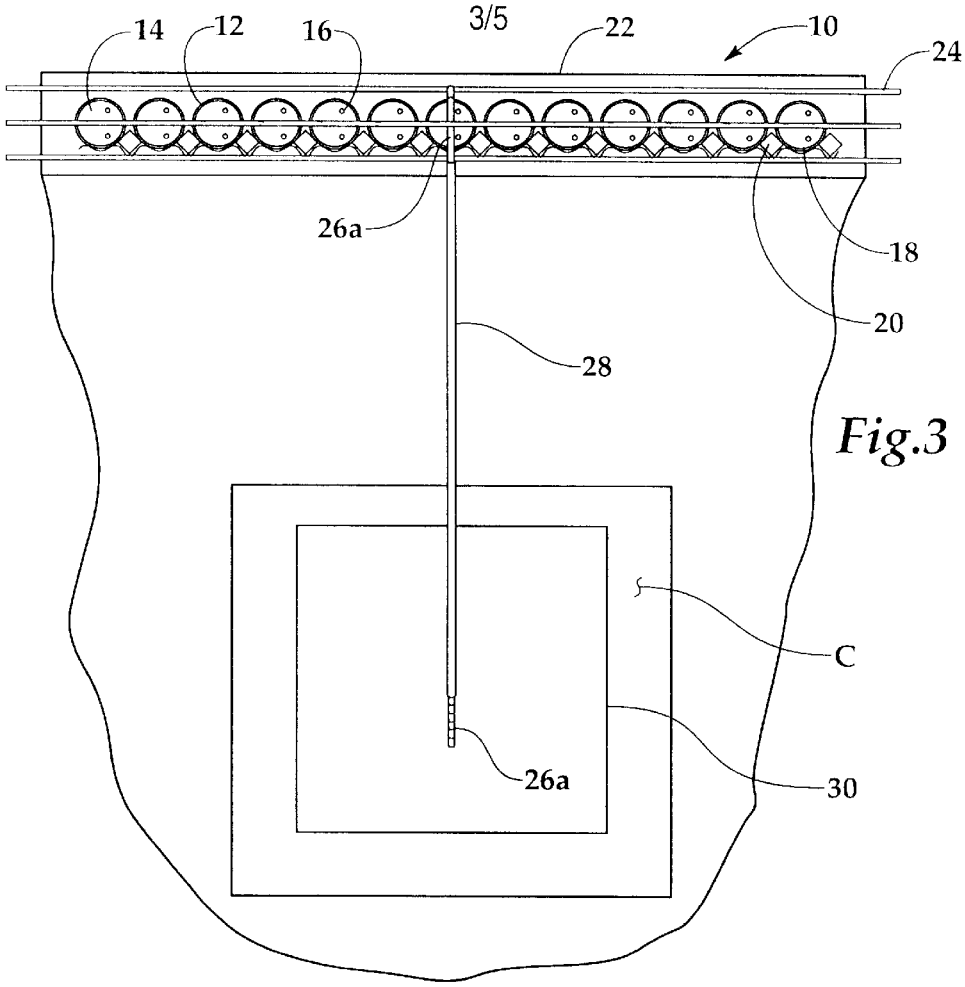
FIG. 3 is a top plan view of FIG. 1.
Figure 6:
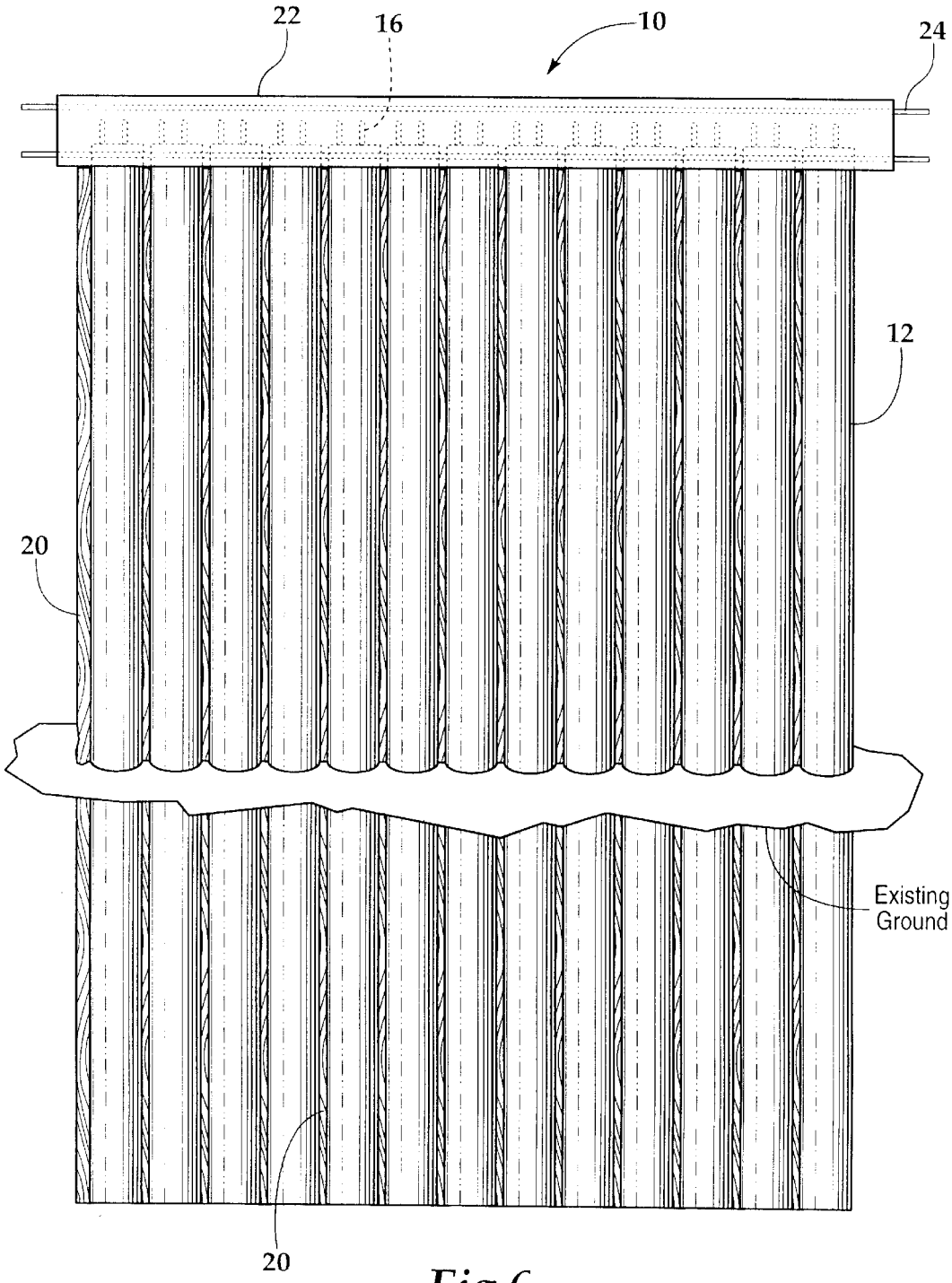
FIG. 6 is a front elevation view of the water side of the sea wall shown in FIG. 1.

Referring now to the drawings and particularly to FIGS. 1, 3 and 6, the invention is there shown generally at numeral 10. The sea wall 10 includes a plurality of elongated, straight tubular members 12 formed of p.v.c. plastic A typical size for these tubular members 12 is about 6" in diameter and 12' to 15' in length. These tubular members 12 are embedded one at a time into the ground G adjacent a body of water to a depth into the ground in the range of about normally 2/3 up to 10:1 in extreme cases of the overall length of each tubular member 12. The preferred method of installing or deploying each of the tubular members 12 into the upright closely spaced orientation is taught in my previous U.S. Pat. No. 5,934,826, which methodology for deploying tubular pilings formed of p.v.c. plastic material is incorporated herein by reference.

Figure 2:
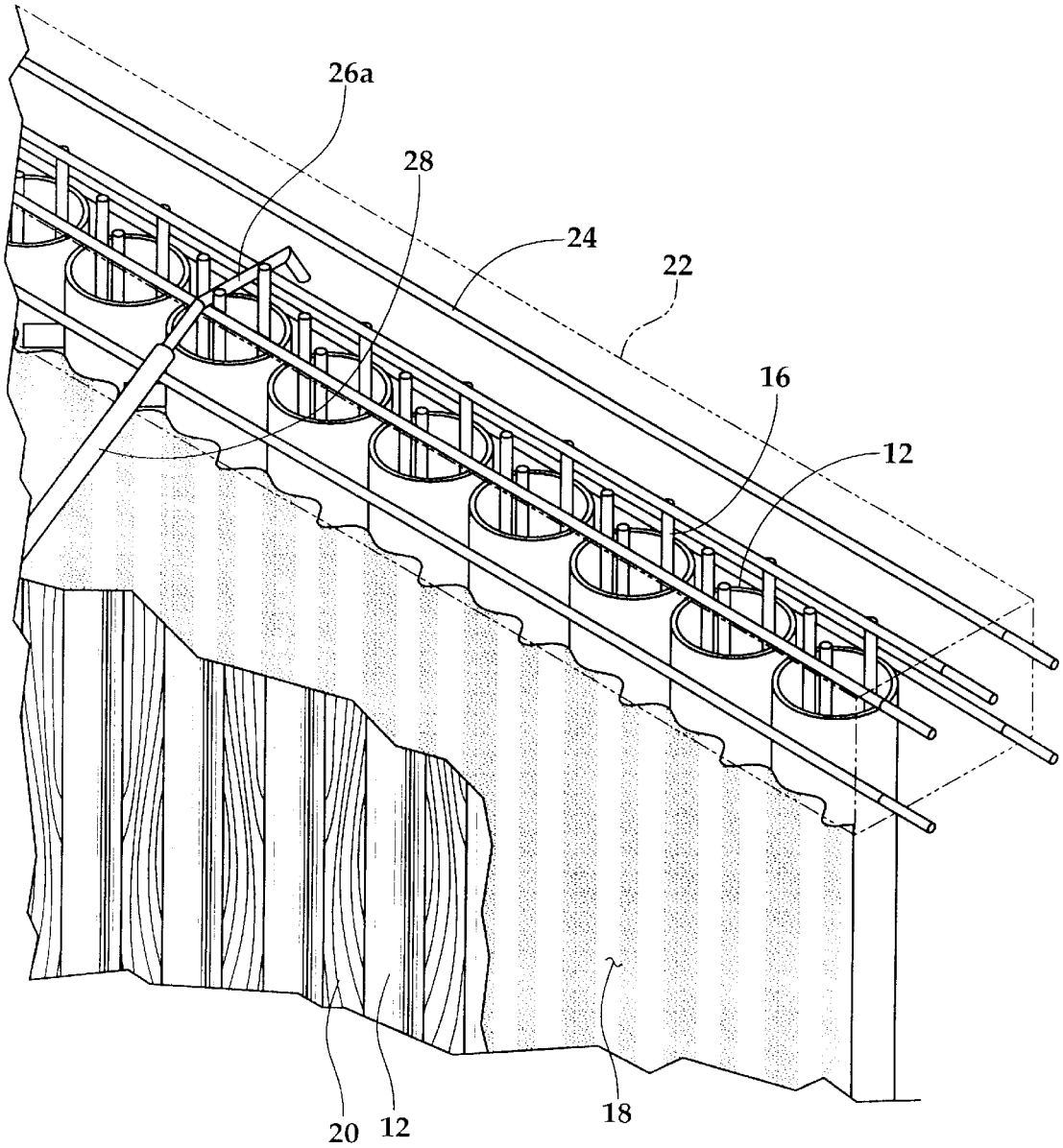
FIG. 2 is an enlarged broken perspective view of the upper portion and cap (in phantom) of the sea wall of FIG. 1.
Figure 4:
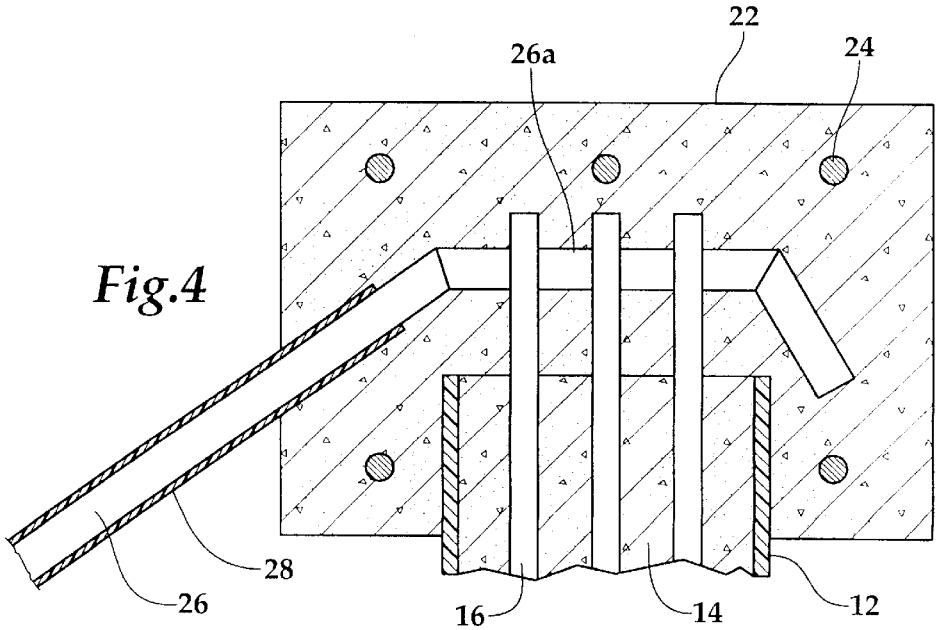
FIG. 4 is an enlarged transverse section view of the upper cap member of FIG. 1.

After the tubular members 12 are deployed as shown, dirt is removed to 1 to 2 feet from the ground end of the PVC and lengths of rebar steel reinforcing rods 16 are placed longitudinally within a substantial portion of the length of each of the tubular members 12 with the upper end portions of each of the rebar members 16 extending above the upper end of each tubular member 12 as best seen in FIGS. 2 and 4.

Thereafter, an appropriate casting form (not shown) is deployed for cast forming a concrete reinforced cap 22. As best seen in FIG. 4, the cap 22 includes a plurality of longitudinally extending rebar reinforcing members 24 and a tie back 26 also formed of rebar reinforcing material which will be described more fully herebelow. After the rebar 24 and tie back end 22*a* are positioned within the temporary form used to form the cap 22, the uncured concrete is poured into the cap form (not shown). Each of the tubular members may be filled with concrete either at the same time that the cap 22 is poured into the cap form or, alternately, the tubular members 12 may have previously been filled with concrete and allowed to cure with the rebar 16 extending above the upper end of each of the tubular members 12 as previously described for secure engagement into the cap 22 and as best seen in FIGS. 2 and 4.

The concrete reinforced cap 22 extends somewhat below the upper end of each of the tubular members for added strength to securely tie all of the tubular members 12 together and to form a more rigid attachment between these components of the sea wall 10. After curing of the concrete, the cap forms are removed and play no further part in the use of the sea wall 10.

To maintain the upright orientation of the sea wall 10 after the cap 22 has been cast formed and cured, one or more tie backs 26 having a p.v.c. tubular protective cover 28 are secured at one end thereof 26*b* into a large concrete anchor 30. The other end 26*a* of each tie back 20 is secured into cap 22 when cast formed and cured. This anchor 30 is casted in place within a compacted earthen side wall C below grade G of the existing ground.

Figure 5:
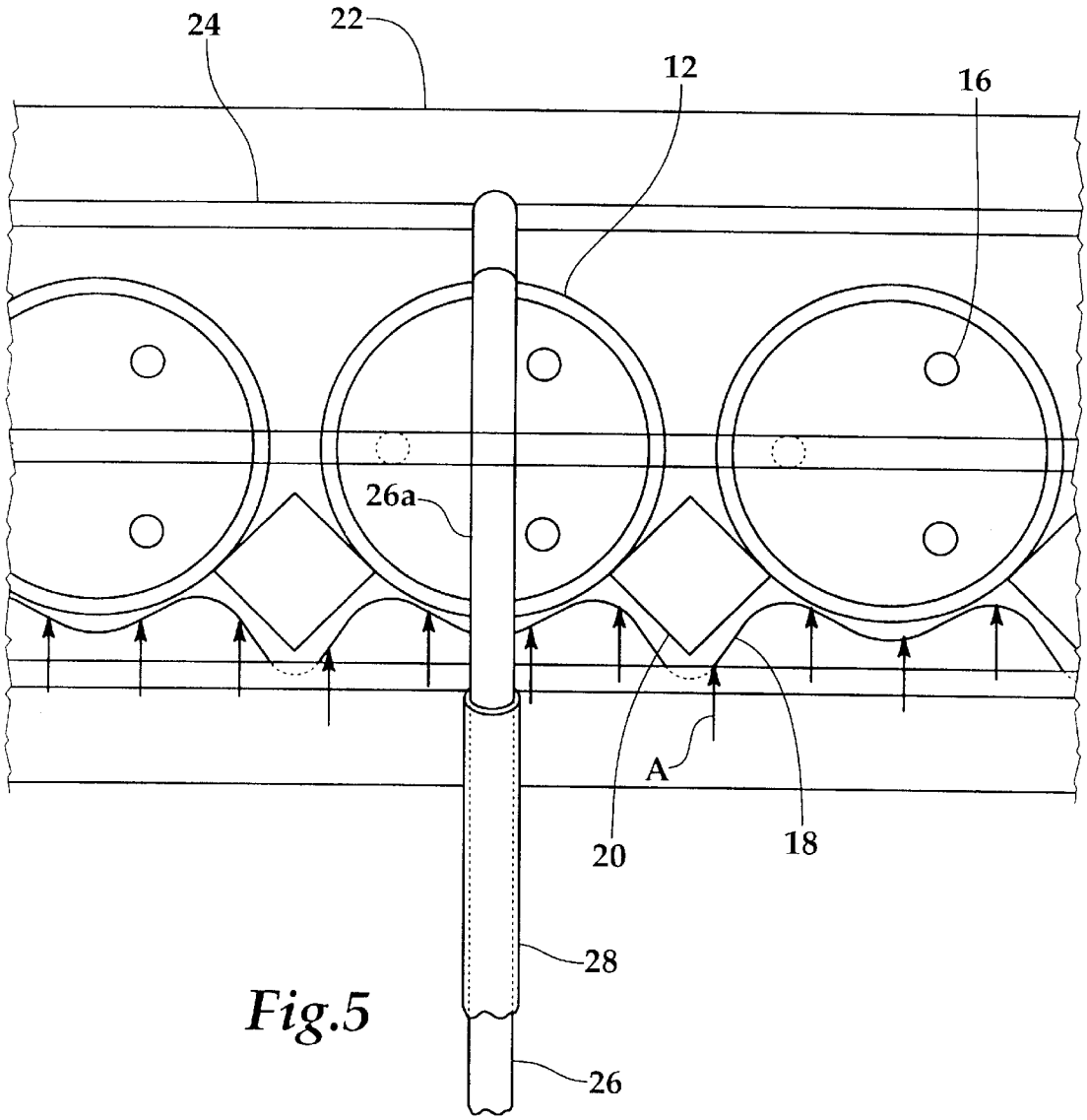
FIG. 5 is an enlarged view of the cap member of FIG. 1.

Prior to back filling with fill dirt up to a desired final grade F shown in phantom in FIG. 1, a layer of filter cloth 18 as best seen in FIGS. 2, 3 and 5 is positioned to cover substantially the entire exposed dry or land side of the tubular members 12. It is preferred that each of the tubular members 12 be in close proximity to, but not in direct contact with, each other to permit drainage of water from the land side. The filter cloth layer 18, when properly deployed as shown, prevents the fill dirt from washing out into the water between adjacent tubular members 12.

Because the filter cloth 18 does not have sufficient structural integrity to self-supportingly span the gap between each of the tubular members 12, an elongated batten 20 is first positioned between each of the tubular members 12 as best seen in FIG. 5. Thereafter, the layer of filter cloth 18 is positioned against the entire dry side of the sea wall 10, each of the tubular members, and the supporting battens 20. It should be noted that the preferred embodiment of these battens is in the form of an elongated wooden member having a 2" cross sectional size. However, any other convenient round, triangular or rectangular cross section member formed of either wood or plastic preferably p.v.c. material may be utilized for this filter cloth supporting function. By this arrangement, the pressure of the fill dirt against the filter cloth 18 in the direction of arrows A in FIG. 5 prevents the filter cloth 18 from begin pushed or stretched in between the tubular members 12 which would likely destroy the integrity of this filter cloth 18.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A sea wall anchored into ground in proximity to a body of water comprising:

a plurality of elongated tubular members arranged in upright side by side relation one to an other forming a sea wall section, a lower portion of each of said plurality of tubular members embedded into, and receiving support from, the ground along an edge of the body of water wherein an upper portion of each said plurality of tubular members extends above the ground;

an elongated generally horizontal rein forced concrete cap extending along and rigidly interconnecting together, each upper end portion of said plurality of tubular members;

each said tubular member substantially filled with a cured aggregate reinforcement;

means for substantially preventing fill dirt placed against one side of said tubular members from washing into the body of water between adjacent said tubular members;

a tie back connected at each end thereof to, and extending between, said cap and a ground anchor spaced from said tubular members.

2. A sea wall as set forth in claim 1, wherein:

said tubular members are formed of p.v.c. plastic material.

3. A sea wall as set forth in claim 1, wherein said means for substantially preventing fill dirt placed against one side of said tubular members from washing into the body of water between adjacent said tubular members includes:

a layer of filter cloth held against one surface of said sea wall section by elongated battens each of which are positioned between adjacent tubular members and against said filter cloth, said filter cloth substantially preventing fill dirt placed against one side of said tubular members from washing into the body of water between adjacent said tubular members.

4. A method of constructing a sea wall anchored into ground in proximity to a body of water, comprising the steps of:

A. providing a plurality of elongated straight tubular members;

B. arranging each of said plurality in upright side by side relation one to another while embedding a lower portion of each said tubular member into, and receiving support from, the ground along an edge of the body of water wherein an upper portion of each of said plurality of tubular members extends above the ground;

C. filling each said tubular member with a curable, hardenable aggregate reinforcement;

D. forming an elongated generally horizontal reinforced concrete cap extending along, and rigidly interconnecting together, each upper end portion of said plurality of tubular members;

E. providing and connecting a sheet filter means for substantially preventing fill dirt placed against one side of said tubular members from washing into the body of water between adjacent said tubular members;

F. providing and connecting a tie back connected at each end thereof to, and extending between, said cap and a ground anchor spaced from said tubular members.

5. The method of claim 4, wherein said tubular members are formed of p.v.c. plastic material.

6. A sea wall anchored into ground in proximity to a body of water comprising:

a plurality of elongated tubular members arranged in upright side by side relation one to another forming a sea wall section, a lower portion of each of said plurality of tubular members embedded into, and receiving support from, the ground along an edge of the body of water, an upper portion of each said tubular member extending above the ground;

an elongated generally horizontal rebar reinforced concrete cap extending along, and rigidly interconnecting together, each upper end portion of said plurality of tubular members;

each said tubular member including longitudinally extending rebar reinforcement which extends into said cap and a cured aggregate reinforcement which substantially fills each said tubular member;

a layer of filter cloth held against one surface of said sea wall section for substantially preventing fill dirt placed against one side of said tubular members from washing into the body of water between adjacent said tubular members;

a tie connected at each end thereof to, and extending between, said cap and a ground anchor spaced from said tubular members.

7. A sea wall as set forth in claim 6, wherein:

said tubular members are formed of p.v.c. plastic material.

* * * * *